US009687080B1

(12) United States Patent
Thiel

(10) Patent No.: US 9,687,080 B1
(45) Date of Patent: Jun. 27, 2017

(54) ADJUSTABLE STOOL

(71) Applicant: Frank W. Thiel, Sterling Heights, MI (US)

(72) Inventor: Frank W. Thiel, Sterling Heights, MI (US)

( * ) Notice: Subject to any disclaimer, the term of this patent is extended or adjusted under 35 U.S.C. 154(b) by 0 days.

(21) Appl. No.: 15/142,199

(22) Filed: Apr. 29, 2016

(51) Int. Cl.

| | |
|---|---|
| ***A47C 9/10*** | (2006.01) |
| ***A47C 9/02*** | (2006.01) |
| ***A47C 3/20*** | (2006.01) |
| ***A47C 11/00*** | (2006.01) |

(52) U.S. Cl.
CPC ..... *A47C 9/10* (2013.01); *A47C 3/20* (2013.01); *A47C 9/02* (2013.01); *A47C 11/00* (2013.01)

(58) Field of Classification Search
CPC .. A47C 9/02; A47C 11/00; A47C 3/20; A47C 3/26; A47C 13/00; B62B 1/042; B62B 3/022; B62B 3/025
USPC ..... 297/423.44; 280/491.1, 79.3
See application file for complete search history.

(56) References Cited

U.S. PATENT DOCUMENTS

| | | | | |
|---|---|---|---|---|
| 1,427,583 | A | | 8/1922 | Davis |
| 1,693,166 | A | | 11/1928 | Walcom |
| 1,771,813 | A | | 7/1930 | Norman |
| 2,443,236 | A | | 6/1948 | Gallagher |
| 2,550,811 | A | | 5/1951 | Herbert |
| 2,673,671 | A | | 3/1954 | Williams |
| 2,725,923 | A | | 12/1955 | Bachrach |
| 2,798,732 | A | | 7/1957 | Craig |
| 2,829,705 | A | | 4/1958 | Godshalk et al. |
| 2,886,186 | A | | 5/1959 | Hamilton |
| 2,993,702 | A | | 7/1961 | Gill |
| 3,172,376 | A | | 3/1965 | Havlis |
| 3,199,683 | A | | 8/1965 | Graswich |
| 3,472,392 | A | | 10/1969 | Hahn |
| 3,587,483 | A | | 6/1971 | Konstant |
| 3,589,746 | A | | 6/1971 | Inglis et al. |
| 3,656,809 | A | | 4/1972 | Ronning |
| 3,721,349 | A | | 3/1973 | Jaffee et al. |
| 3,766,863 | A | | 10/1973 | Swick, Jr. et al. |
| 3,827,573 | A | | 8/1974 | Guerette |
| 3,874,531 | A | | 4/1975 | Mayo |
| 3,971,568 | A | | 7/1976 | Wright |
| 4,109,961 | A | * | 8/1978 | Opsvik ..... A47C 3/20 108/110 |
| 4,128,170 | A | | 12/1978 | Elliott |
| 4,487,134 | A | | 12/1984 | Foote |
| 4,565,403 | A | * | 1/1986 | Brown ..... A47B 83/02 108/38 |

(Continued)

*Primary Examiner* — Timothy J Brindley
(74) *Attorney, Agent, or Firm* — Wayne State Law School Patent Clinic

(57) ABSTRACT

An adjustable stool is transferrable between a stow position and a use position. The adjustable stool includes at least two arms that are pivotally attached to a base. The at least two arms can pivot between two positions. The adjustable stool also includes a seat platform, upon which a user sits, stands, and/or kneels when the adjustable stool is in the use position. The seat platform can engage the at least two arms when the at least two arms are in an upright or angular position relative to the base. The seat platform is selectively suspendable between the at least two arms at different heights relative to the base. The at least two arms are able to fold flat and be contained in the base when the adjustable stool is in the stow position.

9 Claims, 4 Drawing Sheets

(56) References Cited

U.S. PATENT DOCUMENTS 4,607,576 A 8/1986 Kranjec
4,679,818 A 7/1987 Kakavas
4,725,066 A 2/1988 Nootenboom et al.
4,735,426 A 4/1988 McConnell
4,832,355 A 5/1989 Hung
4,895,382 A 1/1990 Andersson
5,222,748 A 6/1993 Johnson
5,285,656 A 2/1994 Peters
5,306,029 A 4/1994 Kaiser, II
5,380,022 A 1/1995 Dennis
5,380,023 A 1/1995 McBee
5,425,545 A 6/1995 McCusker
5,464,237 A 11/1995 Saporiti
5,465,988 A 11/1995 Dennis
5,480,170 A 1/1996 Kaiser, II
5,538,267 A 7/1996 Pasin et al.
5,547,205 A 8/1996 do Rosario Sousa de Cabedo
5,566,961 A 10/1996 Snell et al.
5,634,687 A * 6/1997 Gamble ..... A47D 1/004 297/338
5,718,441 A 2/1998 Kern et al.
5,816,593 A 10/1998 Che
5,820,143 A 10/1998 Rigo
5,833,251 A 11/1998 Peck
5,842,586 A 12/1998 Melby
5,876,047 A 3/1999 Dennis
5,918,891 A 7/1999 Russell
5,941,229 A 8/1999 Schlosser et al.
5,960,968 A 10/1999 Wang
6,010,187 A 1/2000 Dallas et al.
6,079,719 A 6/2000 Tisbo et al.
6,079,720 A 6/2000 Spear et al.
6,132,158 A 10/2000 Pfeiffer et al.
6,193,247 B1 2/2001 Spear et al.
6,213,483 B1 4/2001 Gaffney
6,216,488 B1 4/2001 Rucker
6,318,740 B1 11/2001 Nappo
6,338,493 B1 1/2002 Wohlgemuth
6,378,712 B1 4/2002 Sampl
6,497,424 B2 12/2002 Gartner
6,520,513 B2 2/2003 Presley-Mays
6,669,214 B1 12/2003 Domis
6,799,689 B2 10/2004 Langtry
6,814,362 B2 11/2004 Hanson et al.
6,921,101 B1 7/2005 Lauren
6,932,365 B2 8/2005 Chiappetta et al.
6,944,981 B1 9/2005 Garberg et al.
7,066,476 B2 6/2006 Elden
7,213,817 B2 5/2007 Cheung
7,229,093 B1 6/2007 Carter
7,232,183 B1 6/2007 Haught
7,398,618 B2 7/2008 Schomaker et al.
7,407,170 B1 8/2008 Williams
7,487,977 B2 2/2009 Johnson
7,540,344 B2 6/2009 Yamamoto et al.
7,562,897 B1 7/2009 Sherman
7,648,147 B2 1/2010 Lauer et al.
7,658,442 B1 2/2010 Whiteside et al.
7,661,685 B2 2/2010 Thibault
7,789,401 B2 9/2010 Ambrefe, Jr.
7,854,444 B2 * 12/2010 Zhuang ..... B62B 3/02 280/651
7,913,681 B2 3/2011 Choi et al.
7,963,530 B1 6/2011 Garcia
8,181,811 B1 5/2012 Blake
8,191,907 B2 6/2012 Watson
8,220,823 B2 7/2012 Queen
8,342,544 B1 * 1/2013 Blewett ..... B62B 3/022 211/189
8,388,015 B2 3/2013 Chen
8,465,031 B2 6/2013 Coghill, Jr.
8,479,335 B1 7/2013 Perry
8,596,651 B2 12/2013 Canova
8,602,443 B2 * 12/2013 Moore ..... B62B 3/002 280/651
8,746,377 B1 6/2014 Dunbar
2010/0059951 A1 * 3/2010 Hadar ..... B62B 3/02 280/79.3
2010/0155349 A1 6/2010 Murphy
2011/0115177 A1 5/2011 De Sousa
2012/0013091 A1 1/2012 Giese
2013/0146553 A1 * 6/2013 Preidt ..... A47F 5/00 211/153
2015/0118006 A1 * 4/2015 Wallace-Riley ..... B62B 3/004 414/800
2015/0191189 A1 * 7/2015 Disorbo ..... B62B 3/004 280/47.35
2015/0225006 A1 8/2015 Thiel

* cited by examiner

ADJUSTABLE STOOL

TECHNICAL FIELD

The present disclosure relates generally to adjustable stools.

BACKGROUND

Various seats currently on the market are adjustable using, for example, hydraulics, such as office chairs. However, the seats currently available on the market are not transformable between a stow position and a use position. Also, the seats currently available on the market are not adjustable by selectively suspending the seat at different heights.

SUMMARY

The present disclosure relates to adjustable stools that are transformable between a stow position and a use position. In one example, an adjustable stool includes a base, a first arm, a second arm, and a seat platform. The first arm is pivotally attached to the base adjacent a first end of the base. The second arm is pivotally attached to the base adjacent a second end of the base, where the second end of the base is opposite the first end of the base. The seat platform is selectively suspendable between the first arm and the second arm at different heights relative to the base.

In another example, an adjustable stool includes a base, at least two arms, and a seat platform. The base extends along a plane. The at least two arms are each pivotally attached adjacent opposite ends of the base. The at least two arms pivot relative to the plane between a first position and a second position. The at least two arms extend angular to the plane in the first position. The at least two arms extend substantially parallel to the plane in the second position. The seat platform is selectively suspendable between the at least two arms In another example, an adjustable stool includes a base, a seat platform, a first arm, and a second arm. The seat platform includes two tongues disposed on opposing ends of the seat platform. The seat platform is selectively suspendable between the first arm and the second arm. The first arm is attached adjacent a first end of the base. The first arm includes at least two grooved portions spaced apart from one another at different heights. The grooved portions are sized to receive any one of the two tongues on the seat platform. Each of the at least two grooved portions have a respective support surface. The second arm is attached adjacent a second end opposite the first end of the base. The second arm includes at least two ledges for supporting the other tongue on the seat platform. Each of the two ledges have a respective support surface. The at least two ledges of the second arm are positioned on the second arm such that each of the respective support surfaces of the ledges are substantially parallel to the respective support surfaces of the grooved portions on the first arm.

DETAILED DESCRIPTION

Figure 1:
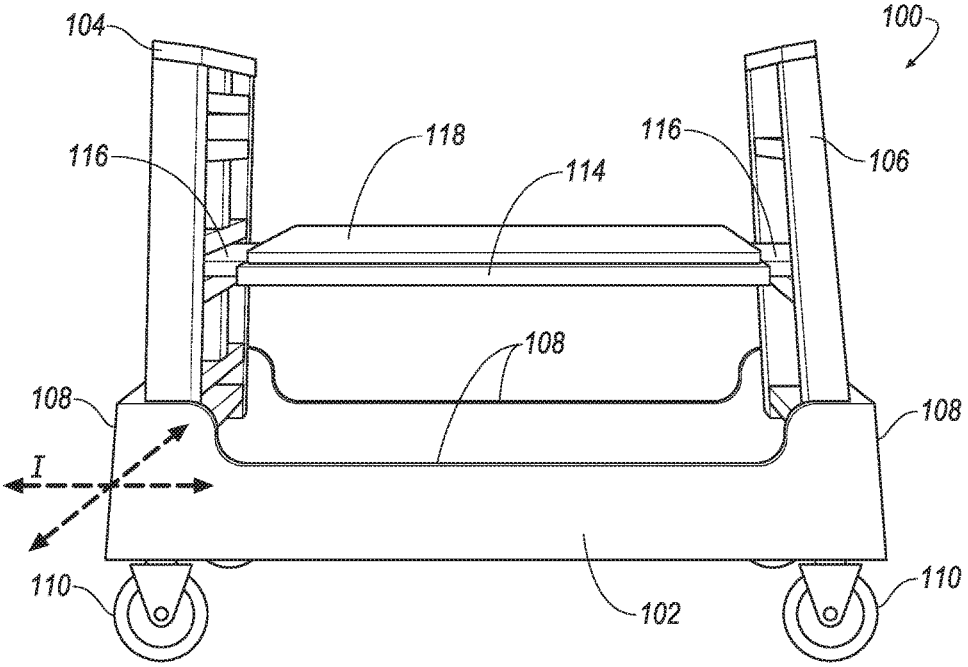
FIG. 1 is a view of an adjustable stool with arms in a use position.

The present disclosure is directed to an adjustable stool. The seat is adjustable and stowable. The adjustable stool includes at least two arms that are attached to a base. The at least two arms can pivot between two positions, a use position and a stow position. The adjustable stool also includes a seat platform, upon which a user sits, stands, or kneels. The seat platform engages the at least two arms when the at least two arms are in the use position. The seat platform is selectively suspendable between the at least two arms at different heights relative to the base. The at least two arms fold flat and are contained in the base when the at least two arms are in the stow position.

Detailed examples are disclosed herein; however, it is to be understood that the disclosed examples are intended only to facilitate the description. Therefore, specific structural and functional details disclosed herein are not to be interpreted as limiting, but merely as a basis for the claims and as a representative basis for teaching one skilled in the art to variously employ the aspects herein in virtually any appropriately detailed structure. Further, the terms and phrases used herein are not intended to be limiting but rather to provide an understandable description of possible implementations. Various examples are shown in FIGS. 1-5C, but the examples are not limited to the illustrated structure or application.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the examples described herein can be practiced without these specific details. The present disclosure incorporates by reference now abandoned U.S. patent application Ser. No. 14/696,673 to Frank William THIEL, titled "Multifunctional Utility Cart", in its entirety.

Figure 2:
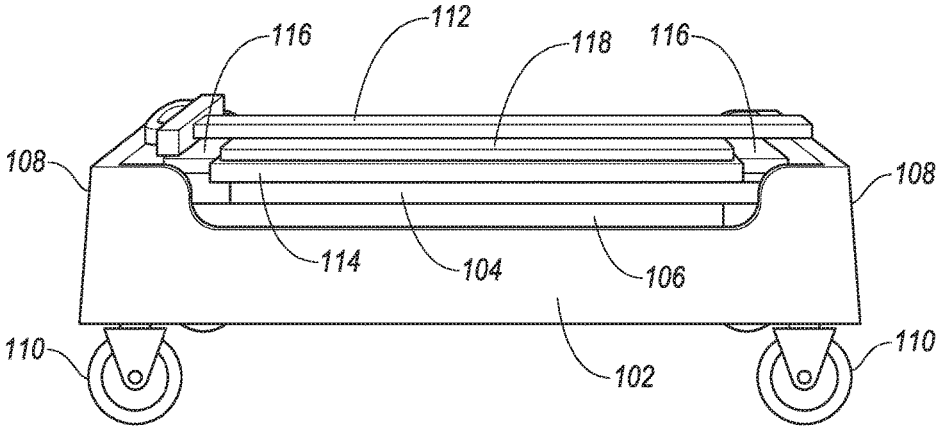
FIG. 2 is a view of an adjustable stool with arms in a stow position.

Referring now to FIG. 1 and FIG. 2, an adjustable stool 100 is shown. The adjustable stool 100 includes a base 102, and at least two arms. As shown in FIG. 1, the adjustable stool can include a first arm 104 and a second arm 106. Exemplary materials used in forming the adjustable stool 100 (including one or more components thereof) includes, for example, wood, plastic, metal, composites, or other generally rigid materials.

The base 102 can extend along a plane I. In one or more arrangements, the first arm 104 and the second arm 106 can be pivotally attached to the base 102. For example, the first arm 104 and the second arm 106 can be pivotally attached to the base 102 adjacent opposite ends of the base 102, as shown in FIGS. 1 and 2. The first and second arm 104, 106 can be attached to the base 102 via, for example, using a hinge bracket, joints, pins which the respective arms can rotate about, etc.

In this example, the first arm 104 and the second arm 106 can rotate between a first position (shown in FIG. 1) and a second position (shown in FIG. 2). The first position can correspond to a use position, and the second position can correspond to a stow position.

In general, the first position can correspond to the first arm 104 and the second arm 106 extending angular to the base 102. For example, the first arm 104 and the second arm 106 can extend angular to the plane I of the base 102. In one or more arrangements, the first arm 104 and the second arm 106 can be maintained in an upright position relative to the base in the first position. In one or more arrangements, the adjustable stool 100 can further include a locking mechanism (not shown) configured to maintain the angular orientation of the first and second arm 104, 106 relative to the base 102.

In general, the second position, shown in FIG. 2, can correspond to the first arm 104 and the second arm 106 extending substantially parallel to the base 102. For example, the first arm 104 and the second arm 106 can extend substantially parallel to the plane I of the base 102. In one or more arrangements, the first arm 104 can fold atop the second arm 106 in the second position. Additionally or alternatively, the second arm 106 can fold atop the first arm 104 in the second position.

As shown in FIG. 2, the first arm 104 and the second arm 106 can fold into and be contained in the base 102 when the first arm 104 and the second arm 106 are in the second position. The base 102 can optionally have walls 108 along the perimeter of the base 102 (or portions thereof). The walls 108 can extend upright relative to the plane I. The walls 108 can define an interior portion, which contains the first arm 104 and the second arm 106 when the first and second arm 104, 106 are in the second position.

The adjustable stool 100 can optionally include wheels 110, and a pull handle 112. The wheels 110 can be positioned on or adjacent to the bottom surface of the base 102, and can facilitate movement of the adjustable stool 100 between different locations. The pull handle 112 can be attached to the base 102. In one or more arrangements, the pull handle 112 can be pivotally attached to the base 102 on one of the walls 108. The pull handle 112 can provide means for a user to pull or push the adjustable stool 100 between different locations.

Figure 3:
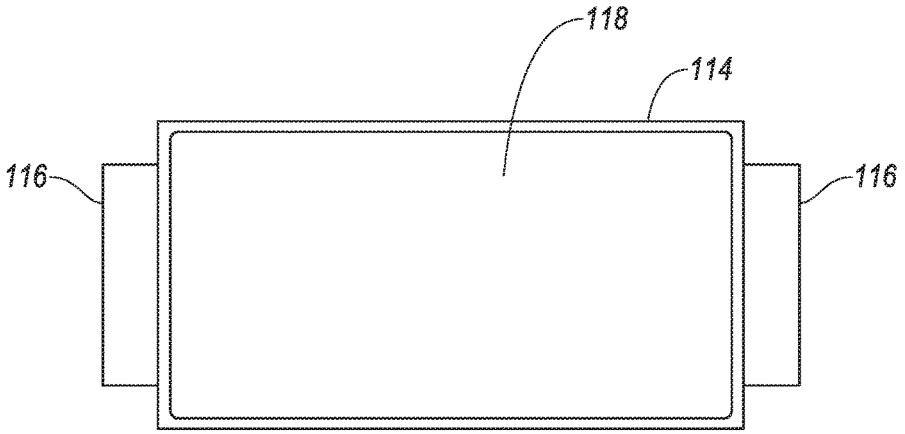
FIG. 3 is a top view of a seat platform of the adjustable stool.

Referring now to FIG. 1 and FIG. 3, the adjustable stool 100 can further include a seat platform 114. FIG. 3 shows a top-view of the seat platform 114.

The seat platform 114 can be selectively suspendable between the first arm 104 and the second arm 106. The seat platform 114 can be selectively suspended between the first arm 104 and the second arm 106 when the first and second arm 104, 106 are in the first position (e.g., the use position shown in FIG. 1). The seat platform 114 can support a user between the first arm 104 and the second arm 106 when the adjustable stool 100 is in the use position. The user can sit, stand, and/or kneel on the seat platform 114.

The first arm 104 and the second arm 106 can fold flat in the second position (e.g., the stow position shown in FIG. 2), and the first arm 104, the second arm 106, and the seat platform 114 can be contained in the base 102. Additionally or alternatively, in arrangements where the pull handle 112 is included, the adjustable stool 100 can fold in an arrangement similar to what is depicted in FIG. 2. For example, the first arm 104, the second arm 106, and the seat platform 114 can fold flat and be contained in the base 102, and the pull handle 112 can fold atop the combination of the first and second arm 104, 106, and the seat platform 114.

As shown in FIG. 3, the seat platform 114 can include tongues 116. The base 112 can be positioned on opposite ends of the seat platform 114. The tongues 116 can extend outward from the seat platform 114. In one or more arrangements, the tongues 116 can extend parallel to the seat platform 114.

The seat platform 114 can further include a cushion 118. The cushion 118 can be positioned on the top surface of the seat platform 114. The cushion 118 can be fixably or removably attached to the seat platform 114. The cushion 118 can be attached to the seat platform 114 by any fastening process including but not limited to staples, glue, stitching, nails, snaps, buttons, fabric hook and loop fastener, or other fastening means. The composition and design of the cushion 118 can include, for example, a foam or polyurethane cushion surrounded by a weather-resistant vinyl covering. The cushion 118 can occupy any portion of a surface area of the top surface of the seat platform 114, from a total coverage of the top surface of the seat platform 114, to the seat platform 114 having no cushion 118.

Figure 4:
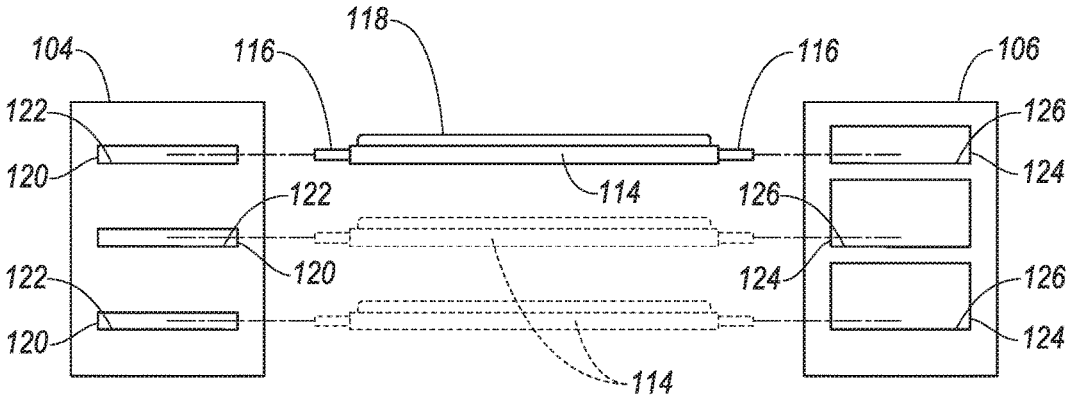
FIG. 4 is a view of arms of the adjustable stool, and the seat platform.
Figure 5A:
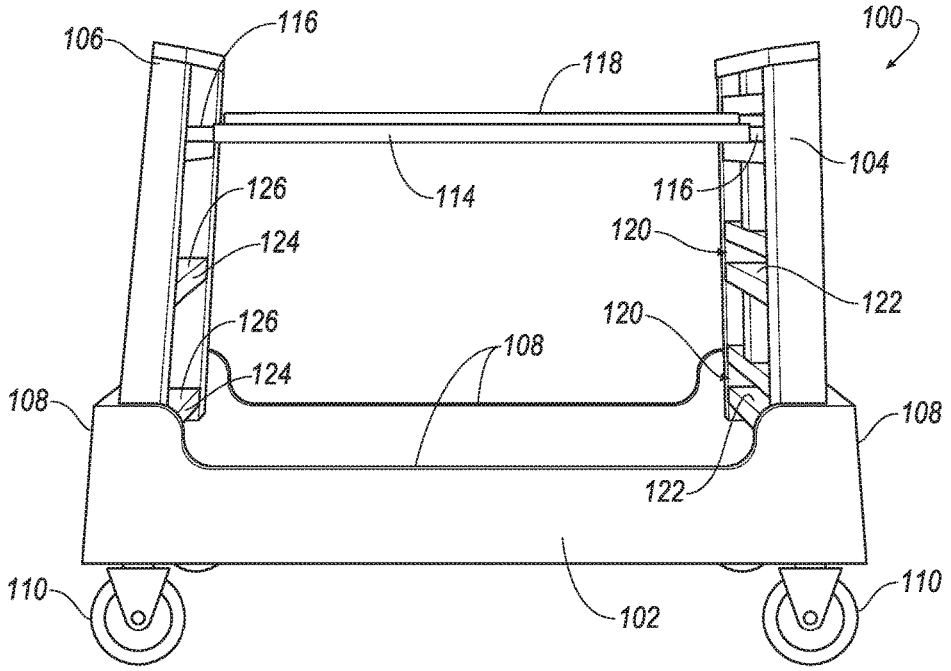
FIGS. 5A-5C show the adjustable stool with the seat platform at different heights.
Figure 5B:
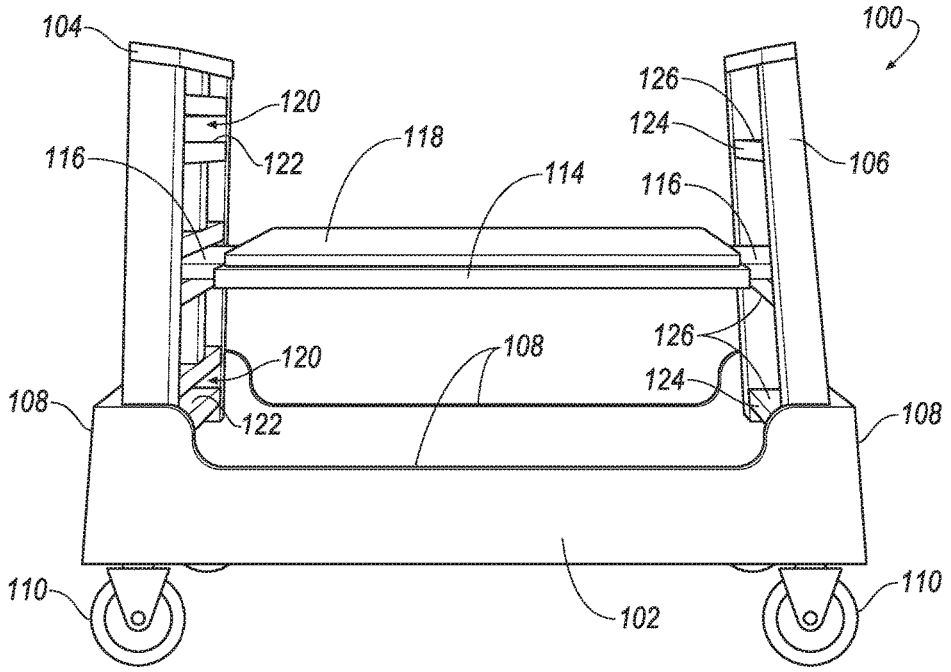
Figure 5C:
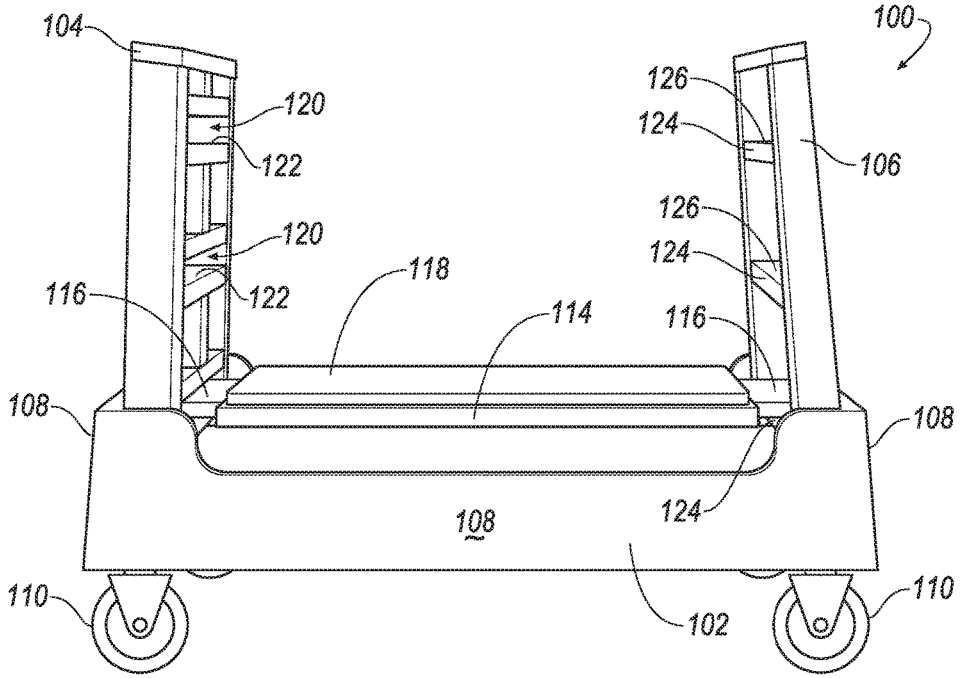

Referring now to FIG. 1, FIG. 3 and FIG. 4, the tongues 116 can engage the arms 104, 106 to selectively suspend the seat platform 114 at different heights from the base 102. FIG. 4 shows a view of the arms 104, 106 of the adjustable stool 100, and the seat platform 114.

The first arm 104 can include at least one groove 120. The grooves 120 can be spaced apart from one another at different heights relative to the base 102. There can be any number of grooves 120, including two grooves 120 shown in FIG. 4, three grooves 120 shown in FIG. 1, and FIG. 5A-5C, or any number of grooves 120. The at least one groove 120 can be sized to receive one of the tongues 116 of the seat platform 114.

The at least one groove 120 can include a respective support surface 122. The support surface 122 can generally extend substantially parallel to a bottom surface of one of the tongues 116, when the first arm 104 is in the first position and the seat platform 114 is engaged to the first arm 104 via the groove 120. The support surface 122 can be the surface that supports one of the tongues 116 of the seat platform 114.

The second arm 106 can include at least one ledge 124. The at least one ledge 124 can be positioned at different heights relative to the base 102. There can be any number of ledges 124, including two ledges 124 shown in FIG. 4, three ledges 124 shown in FIG. 1, and FIG. 5A-5C, or any number of ledges 124. The at least one ledge 124 can support the other tongue 116 of the seat platform 114.

The at least one ledge 124 can include a respective support surface 126. The support surface 126 can generally extend substantially parallel to the bottom surface of the other tongue 116 of the seat platform 114, when the second arm 106 is in the first position and the seat platform 114 is engaged to the second arm 106 via the ledge 124. The support surface 126 can be the surface the supports the other tongue 116 of the seat platform 114 when the second arm 106 is in the first position. The support surface 126 of each of the ledges 124 can be substantially in plane with the support surface 122 of each of the grooves 120 when the first arm 104 and second arm 106 are in the first position. Accordingly, each of the at least one groove 120 can be aligned with each of the at least one ledge 124. When a seat platform 114 is engaged to the two arms 104, 106 in the use position, the grooves 120, ledges 124, and tongues 116 are positioned such that the seat platform 114 extends and is supported in a substantially parallel orientation to the plane I of base 102.

In operation, when a user wishes to transform the adjustable stool 100 from the stow position (shown in FIG. 2) to the use position (shown in FIG. 1), the user can remove the seat platform 114 from the base 102, and unfold each of the arms 104, 106. The user pivots each of the arms 104, 106 from extending substantially parallel to the plane I of the base 102, to angular to the plane I of the base 102. In one or more arrangements, the arms 104, 106 can extend in an upright orientation relative to the plane I of the base 102. The user then rests one of the tongues 116 of the seat platform 114 on one of the ledges 124 of the first arm 104. For example, the user can engage the seat platform 114 at the various heights shown in FIG. 5A-5C. This can be performed by, for example, angling the seat platform 114. The user slides the seat platform 114 where the tongue 116 extends fully into the second arm 106 so that the other tongue 116 is not touching the first arm 104 at any point. Once the tongue 116 is resting on top of one of the ledges 124 of the second arm 106, the user then slides the seat platform 114 towards the first arm 104, so that the other tongue 116 engages the groove 120 of the first arm 104. Accordingly, the groove 120 and the opposing ledge 124 are aligned such that the seat platform 114 extend in a parallel relationship to the base 102 when the adjustable stool 100 is in the use position.

Aspects herein can be embodied in other forms without departing from the spirit or essential attributes thereof. Accordingly, reference should be made to the following claims, rather than to the foregoing specification, as indicating the scope of the invention.

What is claimed is:

1. An adjustable stool, comprising:

a base;

a seat platform having a pair of width edges extending along a width of the seat platform and a pair of length edges extending along a length of the seat platform, the seat platform further including two tongues each extending from a central region of one of the width edges of the seat platform, the seat platform being selectively suspendable between a first arm and a second arm at two or more predetermined heights;

the first arm pivotally attached adjacent a first end of the base, the first arm including at least two grooved portions spaced apart from one another at different heights, the grooved portions sized to receive one of the two tongues on the seat platform, each of the at least two grooved portions having a respective support surface, the first arm including two pillars and the grooved portions extend between the two pillars; and the second arm pivotally attached adjacent a second end opposite the first end of the base, the second arm including at least two ledges for supporting the other tongue on the seat platform, each of the two ledges having a respective support surface, wherein the at least two ledges of the second arm are positioned on the second arm such that each of the respective support surfaces of the ledges are substantially parallel to the respective support surfaces of the grooved portions on the first arm.

2. The adjustable stool of claim 1, wherein the first arm and the second arm are pivotable between a first position and a second position.

3. The adjustable stool of claim 2, wherein:

the first arm and the second arm extend substantially angular to the base in the first position; and the first arm and second arm extend substantially parallel to the base in the second position.

4. The adjustable stool of claim 3, wherein the seat platform is selectively suspendable between the first arm and the second arm when the first arm and second arm are in the first position.

5. The adjustable stool of claim 3, wherein the first arm folds atop the second arm in the second position.

6. The adjustable stool of claim 3, wherein the first arm, the second arm and the seat platform are contained in the base in the second position.

7. The adjustable stool of claim 3, wherein the second arm folds atop the first arm in the second position.

8. The adjustable stool of claim 7, wherein the first arm, the second arm and the seat platform are contained in the base in the second position.

9. The adjustable stool of claim 1, wherein:

the grooved portions each have an upper surface facing a respective one of the support surfaces of the grooved portions, the ledge portions each have an upper surface facing a respective one of the support surfaces of the ledge portions, and a space between the support surface and the upper surface of each grooved portion is less than a space between the support surface and the upper surface of each ledge portion.

* * * * *